United States Patent [19]

Day et al.

[11] Patent Number: 4,586,746

[45] Date of Patent: May 6, 1986

[54] CHILD'S SEAT

[75] Inventors: Diane I. Day, Grand Rapids; Raymond R. Schuiling, Sparta, both of Mich.

[73] Assignee: Sassy, Inc., Northfield, Ill.

[21] Appl. No.: 711,290

[22] Filed: Mar. 13, 1985

[51] Int. Cl.[4] ..... A47B 39/00

[52] U.S. Cl. ..... 297/174; 297/134; 297/156

[58] Field of Search ..... 297/174, 156, 130, 134

[56] References Cited

U.S. PATENT DOCUMENTS

| | | | |
|---|---|---|---|
| 3,052,500 | 9/1962 | Hyde | 297/174 X |
| 3,082,035 | 3/1963 | Goolsby | 297/174 |
| 3,126,226 | 3/1964 | Johnson | 297/174 |
| 3,132,895 | 5/1964 | Pollington | 297/134 |
| 3,216,738 | 11/1965 | Bockus | 297/130 X |
| 3,222,104 | 12/1965 | Remington et al. | 297/174 X |
| 3,253,860 | 5/1966 | Shapiro | 297/174 X |
| 4,230,362 | 10/1980 | Euwema et al. | 297/174 |
| 4,506,928 | 3/1985 | Marion | 297/174 |
| 4,530,539 | 7/1985 | Gaber et al. | 297/174 |

*Primary Examiner*—William E. Lyddane
*Assistant Examiner*—Laurie K. Cranmer
*Attorney, Agent, or Firm*—Dressler, Goldsmith, Shore, Sutker & Milnamow, Ltd.

[57] ABSTRACT

An improved child's seat for mounting at the edge of a table includes a pair of spaced U-shaped frame members and a seat and back releasably secured thereto. The seat and back defines channels which embrace portions of the frame members, and which may be snap-connected thereto for release therefrom. The channels provide extensions which define aligned apertures to snap-receive clip-providing locking pins. A removable vertical restraining post is snap-secured to the seat by locking hooks to prevent a child user from sliding forwardly off the seat. The frame members each mount a vertically extending strut. A lock assembly is slideably mounted on the strut for upward movement to clamp against the lower surface of a table top. The lock assembly resists downward movement via a wedge which bears downwardly against the strut. A spring so maintains the wedge-strut relationship. The wedge may be oscillated from that position to a released position against the force of the spring to permit downwardly movement along the strut to permit release of the child's seat from an associated table.

12 Claims, 6 Drawing Figures

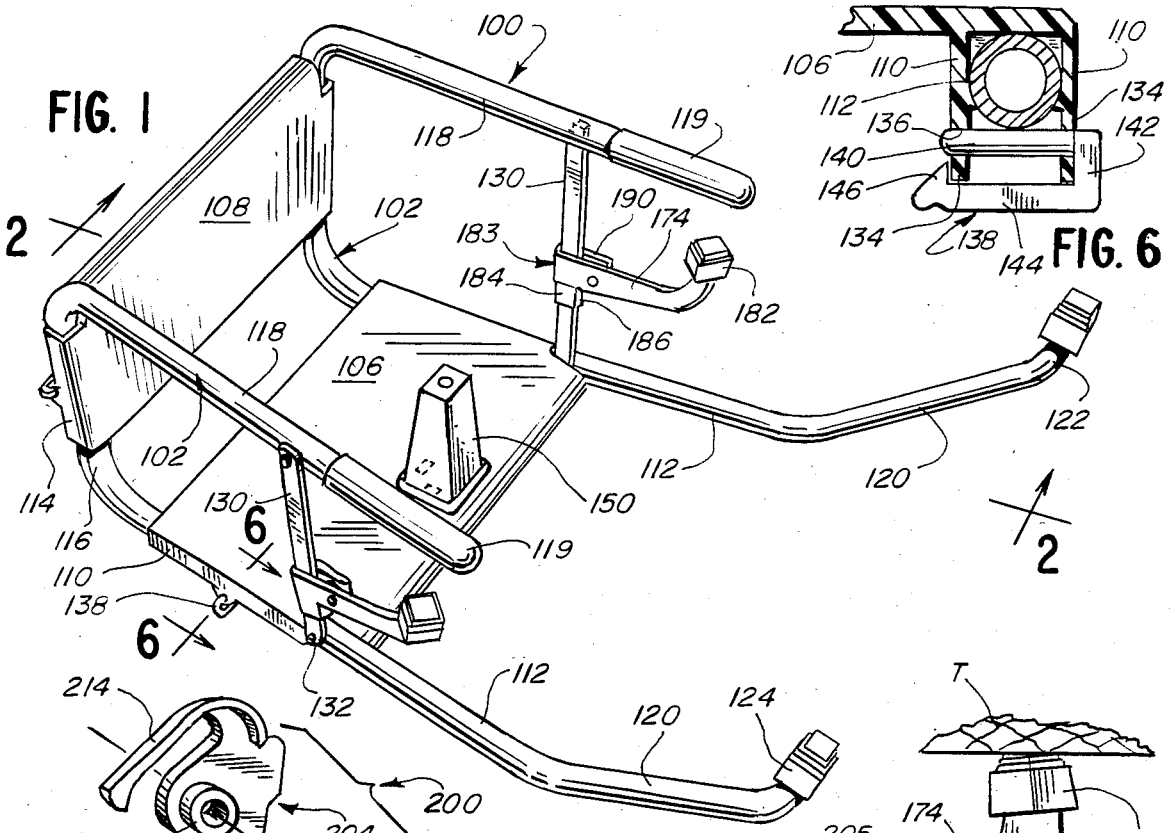
FIG. 1
100
118
119
130
190
174
183
184
182
186
108
102
106
118
102
114
116
110
138
6
6
130
150
119
112
120
122
2
2
132
112
120
124
110
106
110
112
134
136
142
140
146
134
138
144
FIG. 6
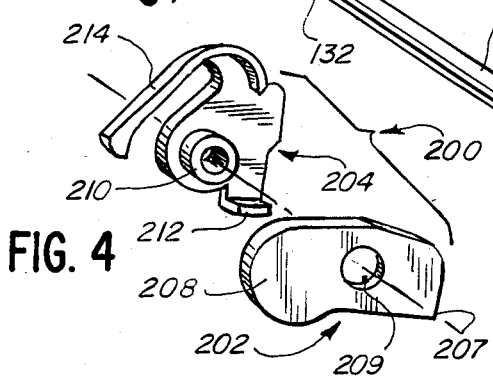
214
200
204
210
212
208
202
209
207
FIG. 4
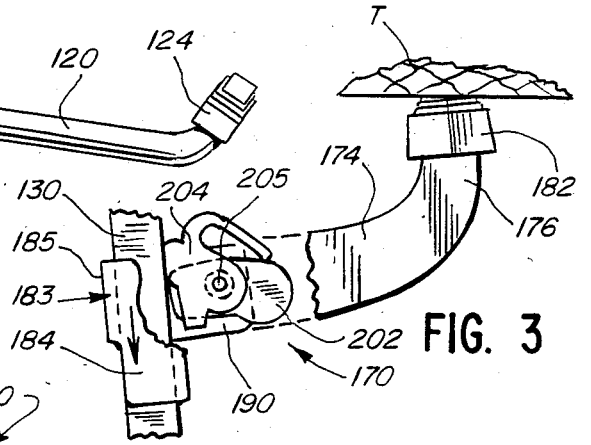
T
174
182
176
130
204
205
185
183
184
202
170
190
FIG. 3
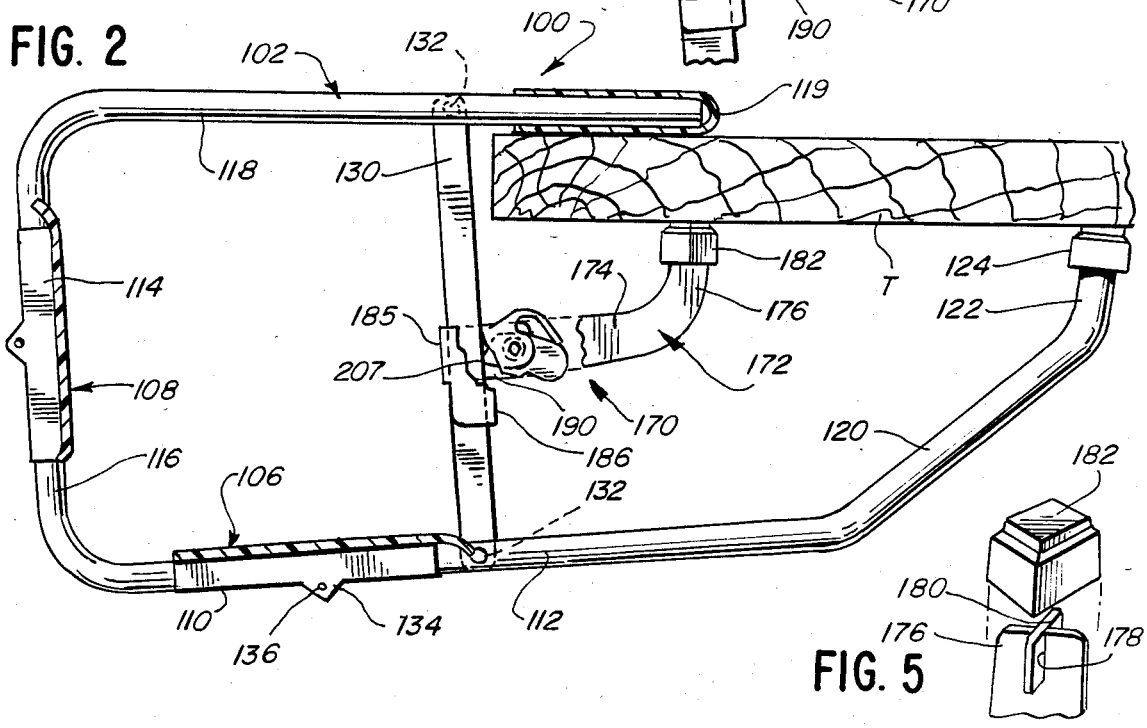
FIG. 2
102
132
100
119
118
130
114
174
182
T
124
176
122
185
207
172
108
190
170
120
186
116
106
132
182
180
110
136
134
112
176
178
FIG. 5

CHILD'S SEAT

BACKGROUND OF THE INVENTION

This invention relates to an improved child's seat and particularly to one which is adapted to be supported directly from a table or the like. It discloses improvements over the subject matter of U.S. Pat. No 4,230,362, and over pending U.S. application Ser. No. 555,340, filed Nov. 20, 1983, now abandoned, owned by the present assignee, and provides important and distinct advantages thereover.

Child's seats of the general type disclosed in U.S. Pat. No. 4,230,362 have been available for many years. Many of them have required complex frames which were expensive to fabricate and assemble, and many have been designed to be collapsible. Many also utilized associated restraining straps or the like to prevent infants and younger children especially from slipping downwardly out of the chair. Typical prior art children's chairs especially intended for table support are shown in U.S. Pat. Nos. 3,253,860; 3,397,010; 3,243,229; 3,222,104; 3,126,226; 2,489,084; 3,132,895; 3,133,760; and 4,469,373.

SUMMARY OF THE INVENTION

In accordance with the present invention an improved child's seat especially configured for support on the edge of a table or the like is provided. It is inexpensively fabricated in several parts, and is adapted to be sold in a flat, knocked-down condition. It is easily and quickly assemblable in minutes into a strong seat which is safe for young infants, as well as for older children, and is designed to be collapsible as well.

The seat incorporates a positive supplemental lock, which, when used, enhances the securance of the seat to an associated table, thereby to assure the security of the occupant of the seat.

In particular, an improved child's table seat of this invention is adapted to be supported on a table. The table seat includes a spaced pair of generally U-shaped, vertically oriented support members in spaced relation to each other. Each generally U-shaped support member has an upper leg portion having a free forward end, a lower leg portion generally parallel to the upper leg portion and having a free forward end, and an integrally formed upwardly extending base section connecting the upper leg portion to the lower leg portion. A strut extends between, and is attached to, the upper leg portion and lower leg portion forwardly of the base section. Seating members are secured to the lower leg portions adjacent the base sections and to the base sections as well.

To prevent users from sliding out of the seat, a vertical restraining post may be connected to the seating member and is disposed generally perpendicular to the seating portion thereof. Means for securing the post to the seating member are provided.

The child's table seat of this invention also desireably includes means for releasably securing the seating means to the lower leg portions and to the base sections and comprises a pair of channels at the sides of each of a seating member and a base member which snap-connect, respectively, to the leg portions and base sections of the support members. Locking pins disposed in the apertures in extension ears of the channels which project below the associated frame portions and which serve to prevent inadvertent removal of the base member and seating member from the support members. The channels may be released from their snap-connected relationship with the frame portions to facilitate folding for storage and transport.

In accordance with the present invention, additional security means for resisting removal of the seat from an associated table are provided. Thus, lock means are provided which are slideably mounted on the strut for movement toward and away from the free end of the upper leg portion and for engaging the lower surface of a table rearwardly of the free end of the lower leg portion. The lock means comprise releasable means for resisting movement of the lock means away from the upper leg portion, thereby firmly to secure a child's table seat to a table.

The lock means may desirably comprise an arm slideably secured to the strut and having an upwardly directed, free forward end adapted to confront the lower surface of a table. The releasable means comprises a movable bearing member adapted to bear downwardly and against the strut to resist downward movement of the arm in a normal position of use, and adapted to be moved to a second position in which the lock means may be slideably moved downwardly along the strut and away from a table. The bearing member may comprise a wedge oscillatably mounted on the arm. The releasable means preferably additionally comprises a spring urging the bearing member into the normal position of use.

In a preferred embodiment, the lock means comprises a yoke at the rear of the arm for receiving the strut, and the bearing member is oscillatably mounted and positioned on the yoke thereby to draw the base of the yoke into bearing engagement with the strut, and the bearing member comprises a wedge and the releasable means additionally comprises a spring urging the wedge into the normal position of use. The wedge may comprise a release finger portion for facilitating oscillation of the wedge out of the normal position of use.

Further objects, features, and advantages of this invention will become apparent from the following description and drawings.

BRIEF DESCRIPTION OF THE DRAWINGS

FIG. 1 is a top perspective view of an improved child's seat of the present invention;

FIG. 2 is a side elevational view of the child's seat of FIG. 1, partially in section as taken along line 2—of FIG. 1, and supported on a table surface;

FIG. 3 is an enlarged fragmentary view of a portion of FIG. 2;

FIG. 4 is an enlarged fragmentary exploded view of portions of FIG. 2;

FIG. 5 is an exploded perspective view of a portion of FIG. 2; and

FIG. 6 is a cross-sectional view taken substantially along line 6—6 of FIG. 1.

DESCRIPTION OF THE PREFERRED EMBODIMENT

Referring now to the drawings of a presently preferred embodiment, a child's table seat 100 of the present invention is shown in perspective view in FIG. 1. The child's seat includes a spaced pair of vertically oriented support or frame members 102 and a seating means comprising a seat member 106 and a back member 108. The seat and back members 106, 108 may be made of relatively rigid plastic.

To facilitate its securance to the frame members 12, the seat member 106 defines a pair of channels 110 at side edges. Channels 110 are proportioned to embrace and be seated in juxtaposition with leg portions 112 of the frame members 102. Back member 108 defines a pair of channels 114 which are proportioned to embrace and be seated in juxaposition with base portions 116 of the frame members 102.

The frame members 102 preferably comprise generally round tubing, as of aluminum, which is bent appropriately into a generally U-shaped configuration, as seen in FIGS. 1 and 2. The closed end or base 116 of each frame member is generally upstanding and vertically oriented. The upper leg 118 of the frame member, extends generally forwardly, and, as seen in FIG. 2, is intended to be supported on an upper surface of a table T. The free forward end 117 of upper leg 118 is ensheathed by a friction sleeve 119. The lower leg 112 of the U-shaped frame member 102 is generally parallel to, and extends forwardly beyond the upper leg 118 and terminates in an upwardly inclined lower leg section 120. The free forward end section 122 of leg section 120 is bent upwardly and is positioned to bear against the lower surface of the table T well inwardly of the peripheral edge of the table on which the child's seat 100 is supported. A suitable friction cap 124 of rubber or plastic may be provided to cover the free end of end section 122. A reinforcing strut 130 is provided to maintain the relationship of the legs 112, 118 of the U-shaped frame member 102 in their illustrated positions relative to each other, thereby to strengthen the seat assembly when it is in use, and for other purposes to be described. Strut 130 is secured to legs 112, 118, as by suitable threaded fasteners 132.

Channels 110 are proportioned to receive and embrace the base portions 116 and the channels 114 are proportioned to receive and embrace lower leg portions 112. The channels 110, 114 each preferably generally conform in shape to the portions of the frame members which they embrace. Thus they are either generally rounded in shape or define segmental portions which are generally circular in shape. Of course, the channels are open so that they may be snap-connected to and released from the frame members. Thus they may define only about 200° of a complete circle (in end view), i.e, a sufficient circumferential extent to provide for good retention, but insufficient to preclude spreading of the edges of the channels to permit snap-connecting to the frame members and removal of the seat and back portions from the associated frame members.

To enhance retention of the seat and back portions, each channel may provide a pair of depending ears 134 which define aligned apertures 136 positioned at elevations which are just below the associated leg and base channel portions 112, 116, respectively. These are adapted to receive suitable releasable keeper means, such as removable keeper clips or pins 138 which prevent inadvertent release of the seat and back members from the frame members. The keeper pins may be as shown in FIG. 6 and comprise a pin member 140 which is sized and proportioned to pass through the aligned apertures 136. The pins 140 are formed with a base portion 142 with which a locking hook 144 is integrally formed. When pin member 140 is pushed through the associated apertures 136 the leading head portion 146 of locking hook 144 is cammed downwardly by the channel ears 134 until the pin 140 is fully seated, following which the locking hook 144 snaps against the outside of an ear 134, thereby preventing inadvertent removal of the pin member from the associated channel members and interlocking them with the associated portion of the frame member. When a seat or back member is to be removed from the frame members 102, the head 146 is manually retracted downwardly, and the keeper pin 138 is then removed.

In most prior art child seats of the type disclosed herein, straps or other members are provided to restrain a child from sliding forward and off the seating member. Such restraints are typically shown in U.S. Pat. No. 4,230,362. In other seats of this type, no restraint is provided.

In accordance with the illustrated device invention, a removable vertical restraining post, as of plastic, and generally in accordance with the disclosure of U.S. application Ser. No. 555,340, here incorporated by reference, is provided. Post 150 comprises an upstanding vertical column which is secured to a series of apertures or slots in seat member 106 via complementary depending locking hooks integrally formed with the base of the post 150. When the post 150 is to be used, the locking hooks, which are arranged in a cruciform array, are positioned to overlie the slots and the post is pushed downwardly. The locking hooks are cammed inwardly slightly until they are pushed fully home at which time the hooks spring outwardly, thereby to interlock the post 150 with the seat member 106. To enhance the integrity of the interlocked relationship between the post and seat member, a security member may be provided as described in said U.S. application Ser. No. 555,340.

Referring now especially to FIGS. 2, 3 and 4, a positive lock means or lock 170 is provided to resist movement of the seat 100 relative to a table T to which it is secured. Lock 170 is slideably mounted on strut 130 for movement toward and away from the free end of the upper leg portion. It is positioned below the free end portion 117 and is positioned, as will be described, to engage the lower surface of a table rearwardly of the free end of the lower leg portion. Table seats, although normally effective for their intended purposes, are sometimes dislodged or pushed off by children who bounce or jiggle the seat, or who push rearwardly with their hands or feet against the table. The lock 170 tends to defeat such actions, thereby providing substantially enhanced security for the occupant of the seat.

Lock 170 includes a formed sheet metal slide bar 172 adapted to confront and engage a table bottom generally below the end of upper leg 102 and slideably secured to the strut 130. Slide bar 172 includes a forwardly extending arm 174 which provides an upwardly directed, free forward end 176 adapted to confront the lower surface of a table. End 176 defines a slot 178 adapted to receive a cross piece 180 to firmly mount a friction cap 182 (see FIG. 5). The other end, the rear end, of arm 174 terminates in a yoke 183 proportioned to receive and slide along strut 130. At that other end, at the yoke, arm 174 provides a depending extension 184 which is formed with a lateral flange 186. Flange 186 is positioned to slide along and bear against the front of the strut 130 when the base or rear portion 185 of yoke 183 confronts the rear of the strut. Thus the sides of the strut are disposed between side sections of the yoke, and the front and rear of the strut are disposed between rear portion 185 and lateral flange 186. As such, when a downward load against the end 176 of arm 174 is applied, the base 185 of the yoke is drawn into bearing engagement with the strut and the flange 186 tends to bear inwardly against the strut to prevent downward sliding movement of the slide bar 172.

Arm 174 and a forward extension 190 of yoke 183 mount a releasable bearing member and spring assembly 200. The bearing member which comprises a wedge 202 and the spring 204 are supported on the slide bar by a suitable fastener, such as a bolt 205 and a lock nut on the bolt. The bolt extends through apertures in arm 174 and extension 190 and oscillatably mount the wedge and spring on the arm 174.

Wedge 202 which may be of stamped metal defines a forward wedge face 207 and a rearward release finger 208. Wedge face 207, in the use position of FIG. 2, bears downwardly against strut 130, and resists downward sliding movement of arm 174 in its normal positioned use. Wedge 202 is normally maintained in its normal use position by spring 204. Spring 204, which may be formed of a resilient plastic, such as nylon, comprises a central mounting hub 210 which is supported on the bolt 205, and on which the wedge 202 is supported via opening 209, a keeper finger 212 which underlies the wedge forwardly of the bolt 205, and a spring finger 214 which resiliently bears against the release finger 208 of the wedge rearwardly of the bolt. Thus, spring finger 214 serves to oscillate the wedge into its normal position of use (its up position), thereby to cause it to bear against the strut's forward edge to resist downward movement of the lock 170 downwardly and away from the uper leg portion of the table seat.

To "release" the lock means and the wedge thereof to facilitate movement of the lock 170 downwardly, the forward end of the wedge is elevated against spring finger 214 and relative to the arm 174. This sufficiently withdraws the wedge face 207 to permit relatively easy sliding movement of the lock downwardly. However, when one attempts to push the arm 174 downwardly without releasing the wedge face, the wedge face 207 tends to more tightly engage the front edge of the strut drawing the yoke 183 into engagement with the rear face of the strut, as well as forcing the flange 186 into firmer engagement with the front edge of the strut. Because this resists downward movment of the lock 170, the top of the table to which the seat is so secured remains gripped and clamped between the ends of the table engaging frame member arms and the lock 170. Thus all normal and most unusual movements of a young child which might cause a more conventional child's seat to move and become displaced are frustrated.

To assemble the child's table seat of the present invention from a condition in which it is adapted to be sold, the locks 170 are moved downwardly along the struts 130 of the preassembled frame members 102. The friction caps and sleeves are then secured to the frame members and locks. The post 150, if it is to be used, is then secured to seat member 106. Seat member 106 and back member 108 are then snap-secured, via their channels 110 and 114 to the frame members 102, and the table seat 100 is then ready for securance to a table top. The keeper pins 130 are then secured to the channel ears 134 as described above.

To attach the seat to a table T, the table seat is gripped from behind and is slid forwardly as far as possible, usually until the struts 130 engage the table edge. At this time, the forward ends of the upper legs 118 overlie the table top and sections 122 of the lower leg portions engage the lower surface of the table top well inwardly of the table edge.

When the seat is so located, while pressing the back of the seat downwardly, one of the locks 170 is lifted until it is firmly clamped against the lower surface of the table top, generally beneath the forward end of the upper leg. That step is repeated for the other lock 170. The seat is then ready to receive a child.

To remove the seat 100, the locks 170 are first released as described above, namely by elevating the release finger 208 against the force of spring finger 214, and by then sliding the lock downwardly. When moved to a lower, non-clamping position, the seat may be easily removed from the table.

To fold the seat for storage or transport, one of the keeper pins 138 is removed, preferably from one side of the back member and that side is then unsnapped from the base 116. The back member is then rotated around to the outside of the associated frame member 102, that frame member is then folded under the seat member and the other frame member is folded over the seat member.

To "reassemble" the seat for use, the steps may be reversed, and the back member channel which was released may be simply snap-connected again to the base portion of the frame member 102.

It will be apparent that the cantilever effect of the child's weight on the seat tends to force the ends 122 (and friction cap 124) against the table bottom, resisting displacement of the seat. To provide further assistance against displacement, the positive grip of the locks 170 tend to clamp the table seat to a table. Although repeated bouncing or jiggling by an active child can stress the system and should of course be discouraged, the locks 170 tend to diminish the likelihood that a table seat will become dislodged. The locks also tend to resist rearward movement which might otherwise more easily occur if a child's hands or feet gain sufficient purchase against the table to push rearwardly.

Although but one embodiment of the present invention has been described in detail, it will be apparent to those skilled in the art that numerous modifications may be made without departing from the spirit and scope of this invention. Accordingly, the invention is to be considered as being limited only insofar as may be made necessary by the appended claims.

What is claimed is:

1. A child's table seat adapted to be supported on a table, said table seat having a spaced pair of generally U-shaped, vertically oriented support members in spaced relation to each other, each said generally U-shaped support member having an upper leg portion having a free forward end, a lower leg portion generally parallel to said upper leg portion having a free forward end, and an upwardly extending base section connecting said upper leg portion to said lower leg portion, and a strut extending between, and attached to, a said upper leg portion and a said lower leg portion, seating means secured to said lower leg portions adjacent said base sections and secured to said base sections, the free end of said upper leg portion being adapted to engage the upper surface of a table and the free end of said lower leg portion extending forwardly beyond said upper leg portion and upwardly, and being adapted to engage the lower surface of a table, lock means slidably mounted on said strut for movement toward and away from said upper leg portion and for engaging the lower surface of a table rearwardly of the free end of said lower leg portion, said lock means comprising releasable means for resisting movement of said lock means away from said upper leg portion thereby firmly to secure a said child's table seat to a table.

2. The child's table seat of claim 1, and wherein said seating means comprises a seat member secured to said lower leg portions and a separate back member secured to said base sections.

3. The child's table seat of claim 1, and wherein said seat member defines a downwardly opening channel at each side thereof adapted to be snap-connected to, and released from, said lower leg portions and said back member defines a rearwardly opening channel at each side thereof adapted to be snap-connected to, and released from, said base sections, whereby when one of said channels is released from its associated portion or member, the child's table seat may be folded into a generally flat condition for storage or transport.

4. The child's table seat of claim 3, and wherein said seat member channels comprise ears depending below the lower leg portions and said back member channels comprise ears extending behind said base sections, and releasable keeper means secured to said ears to prevent inadvertant release of the seat and back members from the support members.

5. The child's table seat in accordance with claim 4 and wherein said ears define apertures and said keeper means comprise keeper pins having a pin portion extending through a pair of ear apertures and locking hook means interlocked with a said ear to prevent release and inadvertent removal of said pin portion from said apertures.

6. The child's table seat of claim 1, and further comprising a vertical restraining post removably connected to said seat member and disposed generally perpendicular thereto and means for securing said post to said seat member.

7. The child's table seat of claim 1, and wherein said lock means comprises an arm slidably secured to said strut and having an upwardly directed, free forward end adapted to confront the lower surface of a table, and said releasable means comprises a movable bearing member adapted to bear downwardly and against said strut to resist downward movement of said arm in a normal position of use, and adapted to be moved to a second position in which said lock means may be slidably moved downwardly along said strut, and away from a table.

8. The child's table seat of claim 7, and wherein said bearing member comprises a wedge oscillatably mounted on said arm.

9. The child's table seat of claim 7, and wherein said releasable means additionally comprises a spring urging said bearing member into said normal position of use.

10. The child's table seat of claim 7, and wherein said lock means comprises a yoke at the rear of said arm for receiving said strut, and said bearing member is oscillatably mounted and positioned on said yoke thereby to draw the base of the yoke into bearing engagement with said strut.

11. The child's table seat of claim 10, and wherein said bearing member comprises a wedge and said releasable means additionally comprises a spring urging said wedge into said normal position of use.

12. The child's table seat of claim 11, and wherein said wedge comprises a release finger portion for facilitating oscillation of said wedge out of said normal position of use.

* * * * *